US009104150B2

(12) United States Patent
Toyoda et al.

(10) Patent No.: US 9,104,150 B2
(45) Date of Patent: Aug. 11, 2015

(54) FIXING UNIT, IMAGE FORMING APPARATUS INCORPORATING THE FIXING UNIT, AND IMAGE FORMING METHOD

(71) Applicants: Minoru Toyoda, Hyogo (JP); Tomohiko Fujii, Hyogo (JP); Tomoya Adachi, Hyogo (JP); Yutaka Naitoh, Hyogo (JP); Yoshiharu Takahashi, Osaka (JP); Hitoshi Fujiwara, Osaka (JP); Yasuharu Kawarasaki, Osaka (JP)

(72) Inventors: Minoru Toyoda, Hyogo (JP); Tomohiko Fujii, Hyogo (JP); Tomoya Adachi, Hyogo (JP); Yutaka Naitoh, Hyogo (JP); Yoshiharu Takahashi, Osaka (JP); Hitoshi Fujiwara, Osaka (JP); Yasuharu Kawarasaki, Osaka (JP)

(73) Assignee: Ricoh Company, LTD., Tokyo (JP)

( * ) Notice: Subject to any disclaimer, the term of this patent is extended or adjusted under 35 U.S.C. 154(b) by 27 days.

(21) Appl. No.: 14/012,340

(22) Filed: Aug. 28, 2013

(65) Prior Publication Data

US 2014/0072354 A1 Mar. 13, 2014

(30) Foreign Application Priority Data

Sep. 13, 2012 (JP) ..... 2012-201615

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
USPC ..... 399/122, 328, 329, 330
See application file for complete search history.

(56) References Cited

U.S. PATENT DOCUMENTS

| | | | | |
|---|---|---|---|---|
| 8,693,936 | B2 * | 4/2014 | Nanno et al. | 399/329 |
| 2008/0175633 | A1 | 7/2008 | Shinshi | |
| 2011/0229228 | A1 * | 9/2011 | Yoshikawa et al. | 399/329 |
| 2012/0177420 | A1 * | 7/2012 | Shimokawa et al. | 399/329 |
| 2012/0177422 | A1 | 7/2012 | Nanno et al. | |
| 2012/0275834 | A1 | 11/2012 | Naitoh et al. | |
| 2013/0064586 | A1 | 3/2013 | Adachi et al. | |

FOREIGN PATENT DOCUMENTS

| | | |
|---|---|---|
| JP | 2008-158482 | 7/2008 |
| JP | 2008-275755 | 11/2008 |
| JP | 2012-145708 | 8/2012 |

* cited by examiner

*Primary Examiner* — David Gray
*Assistant Examiner* — Michael Harrison
(74) *Attorney, Agent, or Firm* — Harness, Dickey & Pierce, P.L.C.

(57) ABSTRACT

A fixing unit includes an endless belt unit accommodating a heat source, a pressure roller to rotate in contact with the fixing belt unit forming a pressure border therebetween, and a heat transfer member heated by the heat source to heat the fixing belt unit. The heat transfer member is secured inside an inner circumferential surface of the fixing belt unit and supports the fixing belt unit. A fixed member is secured inside the inner circumferential surface of the fixing belt unit and is pressed against the pressure roller via the fixing belt unit. The heat transfer member has at least one convex portion partially formed in an outer circumferential surface of the heat transfer member in a rotational direction of the fixing belt unit and a longitudinal direction of the heat transfer member to narrow a gap formed between the heat transfer member and the fixing belt unit.

20 Claims, 12 Drawing Sheets

FIXING UNIT, IMAGE FORMING APPARATUS INCORPORATING THE FIXING UNIT, AND IMAGE FORMING METHOD

CROSS-REFERENCE TO RELATED APPLICATION

This patent application is based on and claims priority pursuant to 35 U.S.C. §119 to Japanese Patent Application No. 2012-201615, filed on Sep. 13, 2012 in the Japan Patent Office, the entire disclosure of which is hereby incorporated by reference herein.

BACKGROUND

1. Technical Field

The present invention relates to a fixing unit and an image forming apparatus with the fixing unit. In particular, the present invention relates a fixing unit attached to an image forming apparatus, such as a copier, a facsimile, a printer, etc., employing electrophotography, and an image forming method executed by the image forming apparatus.

2. Related Art

At present, various designs of image forming apparatuses, such as copiers, facsimiles, printers, etc., which employ electrophotography, have been developed and publicly known. An image formation process employed in the image forming apparatus is typically executed in the following steps. Specifically, an electrostatic latent image is initially formed on a surface of a photoconductive drum serving as an image bearer. The electrostatic latent image on the surface of the photoconductive drum is subsequently developed and rendered visible by developer, such as toner, etc. The developed image is subsequently transferred onto a recording medium (hereinafter, sometimes referred to as a sheet, a recording sheet, a recording member, a transfer member) by a transfer unit and is borne thereon. Subsequently, a fixing unit fixes the toner image borne on the recording sheet with pressure and heat, etc.

The fixing member and the pressing member are generally either opposed rollers or belts, respectively, or a combination of a roller and a belt, and are positioned adjacent to each other to form a fixing nip (hereinafter, simply referred to as a nip) therebetween, through which the recording medium bearing a toner image is conveyed.

For example, in a roller-type fixing unit, in which a fixing roller and a pressing roller are pressed against each other and form the nip therebetween, a recording medium bearing an unfixed toner image thereon is passed though the nip between the fixing roller and the pressing roller. One or both of these two rollers generally accommodates a heat source, such as a halogen heater, etc., and rotates while being heated and pressed against the other roller at the same time. Thus, the unfixed toner image is heated and pressed, and melts thereby being fixed on the recording medium at the same time.

In recent years, in accordance with a growing demand for greater energy efficiency while also shortening a waiting time needed for heating a fixing unit (e.g., a warming-up time, a first time to print, etc.,), a so-called on-demand fixing unit is widely adopted, in which an endless belt unit composed of a belt or a thin film and the like is employed instead of a roller unit including a fixing roller or the like. Such an arrangement serves to reduce heat capacity of the fixing unit, thereby improving efficiency of heat transfer to the recording medium while significantly shortening waiting time As an example of this kind of known fixing unit, JP-2008-158482-A discloses a fixing system in which a fixed member (e.g., an opposed member) is pressed against an inner circumferential surface of a belt unit and a pressure roller (e.g., a pressing roller) via the fixed belt unit while sliding along the belt unit and forming a fixing nip therewith. A recording medium is conveyed to the nip to fix a toner image on the recording medium. A heat transfer member (e.g., a heating member) is also provided in the system to support the fixing belt unit by either approaching or contacting the inner circumferential surface of the fixing belt unit at a prescribed position except for the nip.

When a relatively heavy load is applied to the nip to obtain a given amount of nip pressure in the fixing unit, a torque increases in the nip thereby possibly raising a problem. Such a problem can be solved if a contact area (i.e., a friction sliding area) between the fixing belt unit and the heat transfer member is reduced, thereby minimizing the torque therein. To reduce the contact area and accordingly suppress increasing in torque in a fixing unit, JP-2012-145708-A discloses prescribed grooves formed in a surface not heated by a heater outside of a heated area of the heating device and extended perpendicular to a direction in which a recording medium passes through a fixing nip N.

JP-2008-275755-A also discloses a heating device, in which a film unit (i.e., a belt member) and a film unit holder that holds the film unit are provided. The film unit holder includes a recessed portion in its surface contacting the inner circumferential surface of the film unit to reduce a contact area in which the film unit and the film unit holder contact each other. Hence, by reducing the contact area, torque required in the contact area can be reduced.

However, reducing the contact area of the heat transfer member and the inner circumferential surface of the fixing belt unit widens a gap formed between the heat transfer member and the inner circumferential surface of the fixing belt unit resulting in unstable movement of the fixing belt as a problem.

Further, although the torque can be reduced by the conventional systems as disclosed in the JP-2012-145708-A and JP-2008-275755-A, the gap between the heat transfer member and the inner circumferential surface of the fixing belt unit cannot be reduced, and accordingly the problem of unstable movement of the fixing belt remains unsolved.

SUMMARY

Accordingly, one aspect of the present invention provides a novel fixing unit for fixing an unfixed toner image borne on a recording medium onto the recording medium by applying a pressure heating process thereto at a pressure border. Such a fixing unit includes an endless belt unit accommodating a heat source inside thereof and a pressure roller to rotate in contact with the fixing belt unit. The pressure roller and the fixing belt unit collectively form the pressure border therebetween. A heat transfer member is heated by the heat source and heats the fixing belt unit. The heat transfer member is secured inside an inner circumferential surface of the fixing belt unit and supports the fixing belt unit. A fixed member is secured inside the inner circumferential surface of the fixing belt unit and is pressed against the pressure roller via the fixing belt unit. The heat transfer member has at least one convex portion partially formed in an outer circumferential surface of the heat transfer member in a rotational direction of the fixing belt unit and a longitudinal direction of the heat transfer member to narrow a gap between the heat transfer member and the fixing belt unit.

Another aspect of the present invention provides a novel image forming apparatus that includes an unfixed toner image formation system to form an unfixed toner image on a recording medium, and a fixing unit to fix the unfixed toner image borne on the recording medium onto the recording medium by applying a pressure heating process thereto at a pressure border. The fixing unit includes an endless belt unit accommodating a heat source inside thereof and a pressure roller to rotate in contact with the fixing belt unit. The pressure roller and the fixing belt unit collectively form the pressure border therebetween. A heat transfer member is heated by the heat source and heats the fixing belt unit. The heat transfer member is secured inside an inner circumferential surface of the fixing belt unit and supports the fixing belt unit. A fixed member is secured inside the inner circumferential surface of the fixing belt unit and is pressed against the pressure roller via the fixing belt unit. The heat transfer member has at least one convex portion partially formed in an outer circumferential surface of the heat transfer member in a rotational direction of the fixing belt unit and a longitudinal direction of the heat transfer member to narrow a gap between the heat transfer member and the fixing belt unit.

Yet another aspect of the present invention provides a novel method of forming a toner image. The method comprises the steps of: forming an unfixed toner image on a recording medium with an unfixed toner image formation system; conveying the recording medium with the unfixed toner to a fixing nip formed between an endless belt unit accommodating a heat source inside thereof and a pressure roller to rotate in contact with the fixing belt unit, the endless belt unit being pressed against the pressure roller by a fixed member secured inside an inner circumferential surface of the fixing belt unit; heating a heat transfer member secured inside the inner circumferential surface of the fixing belt unit by the heat source; supporting the fixing belt unit with heating a heat transfer member via at least one convex portion partially formed in an outer circumferential surface of the heat transfer member in a rotational direction of the fixing belt unit and a longitudinal direction of the heat transfer member to narrow a gap between the heat transfer member and the fixing belt unit; heating the fixing belt unit via the heat transfer member; and fixing the unfixed toner image borne on the recording medium onto the recording medium by applying pressure and heat thereto in the fixing nip.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
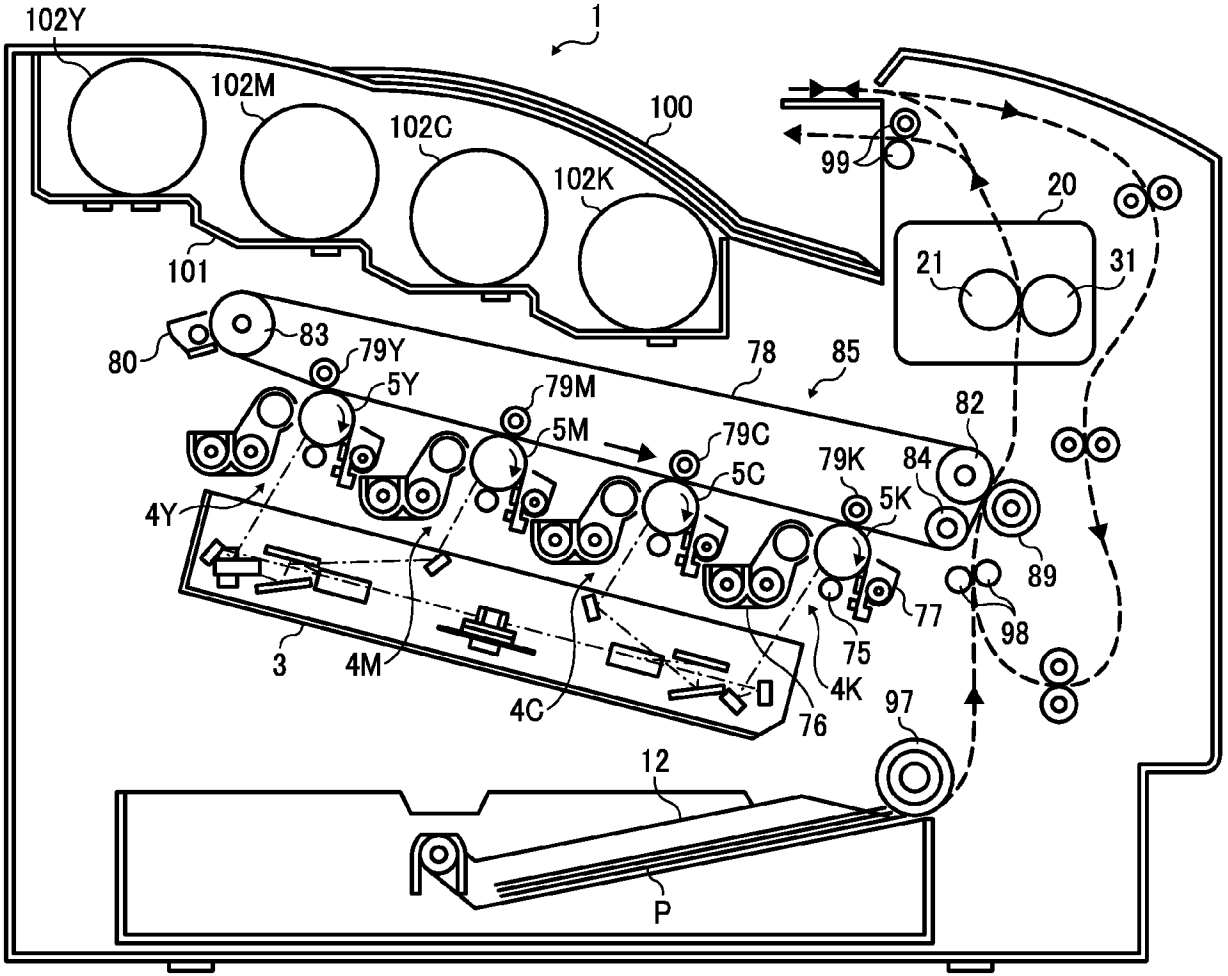
FIG. 1 is a cross-sectional view illustrating an exemplary image forming apparatus according to one embodiment of the present invention.

Referring now to the drawings, wherein like reference numerals designate identical or corresponding parts throughout the several views thereof and in particular to FIGS. 1 to 14, several configurations of various embodiments of the present invention are described.

A first embodiment of the present invention is initially described with reference to FIG. 1, in which an overall configuration of a tandem type color printer as an image forming apparatus is schematically illustrated. As shown there, an overview interior configuration and operation of the image forming apparatus are illustrated.

Specifically, four toner bottles 102Y, 102M, 102C, and 102K are detachably attached (i.e., freely replaceable) to a bottle container unit 101 disposed at an upper side in a main body 1 of the image forming apparatus corresponding to respective component colors (i.e., yellow, magenta, cyan, and black).

Below the bottle container unit 101, an intermediate transfer unit 85 accommodating an intermediate transfer belt 78 is provided. Multiple image formation units 4Y, 4M, 4C, and 4K are positioned side by side opposite the intermediate transfer belt 78 of the intermediate transfer unit 85 corresponding to respective component colors (i.e., yellow, magenta, cyan, and black).

In the respective image formation units 4Y, 4M, 4C, and 4K, photoconductive drums 5Y, 5M, 5C, and 5K are disposed.

Around each of the respective photoconductive drums 5Y, 5M, 5C, and 5K, a charging unit 75, a developing unit 76, a cleaning unit 77, and a charge removing unit (not shown) or the like are also provided.

On the respective photoconductive drums 5Y, 5M, 5C, and 5K, image formation processes (i.e., charging processes, exposure processes, developing processes, transfer processes and cleaning processes) are held, so that component color images are formed on thereon, respectively.

The photoconductive drums 5Y, 5M, 5C, and 5K are driven clockwise in FIG. 1 by a driving motor or motors, not shown. At the same time, the surfaces of the photoconductive drums 5Y, 5M, 5C, and 5K are uniformly charged at respective positions of the charging units 75 (in the charging processes).

Subsequently, the surfaces of the photoconductive drums 5Y, 5M, 5C, and 5K reach spots, to which laser light beams are emitted from an exposing unit 3, respectively, so that electrostatic latent images are formed at these spots in exposure scanning processes corresponding to component colors (in the exposure processes).

Subsequently, the surfaces of the photoconductive drums 5Y, 5M, 5C, and 5K reach positions opposed to the developing units 76 and the electrostatic latent images are developed at these locations so that component color toner images are formed (i.e., in the developing processes), respectively.

Subsequently, the surfaces of the photoconductive drums 5Y, 5M, 5C, and 5K reach prescribed positions opposed to the intermediate transfer belt 78 and second transfer bias rollers 79Y, 79M, 79C, and 79K as well, so that the component color toner images borne on the photoconductive drums 5Y, 5M, 5C, and 5K are transferred 78 onto the intermediate transfer belt at these positions (in primary transfer processes).

At this moment, a few un-transferred toner particles remain on the photoconductive drums 5Y, 5M, 5C, and 5K, respectively.

Subsequently, however, the surfaces of the photoconductive drums 5Y, 5M, 5C, and 5K reach prescribed positions opposed to the cleaning units 77, and the residual toner particles on the photoconductive drums 5Y, 5M, 5C, and 5K are mechanically collected at these positions by cleaning blades provided in the cleaning units 77, respectively, during the cleaning processes.

Finally, the surfaces of the photoconductive drums 5Y, 5M, 5C, and 5K reach prescribed positions opposed to the charge-removing units, not shown, and residual potentials remaining on the photoconductive drums 5Y, 5M, 5C, and 5K at that time are removed at these positions, respectively. Hence, a series of the image formation processes to be held on the respective photoconductive drums 5Y, 5M, 5C, and 5K have been completed in this way.

Subsequently, each of the component color toner images formed on each of the photoconductive drums through the developing process is transferred and overlaid one by one onto the intermediate transfer belt 78. In this way, a full-color image is formed on the intermediate transfer belt 78.

Here, the intermediate transfer unit 85 is composed of the intermediate transfer belt 78 as already described, four primary transfer bias roller 79Y, 79M, 79C, and 79K, a secondary transfer backup roller 82, a cleaning backup roller 83, a tension roller 84, and an intermediate transfer cleaning unit 80 or the like.

The intermediate transfer belt 78 is supported and stretched by three rollers 82 to 84, and is endlessly driven to move by rotary driving force of one of these rollers (e.g. the roller 82) in a direction as shown by arrow in FIG. 1. Respective four primary transfer bias rollers 79Y, 79M, 79C, and 79K and the photoconductive drums 5Y, 5M, 5C, and 5K sandwich the intermediate transfer belt 78 in therebetween thereby forming primary transfer nips there, respectively.

Further, to the respective primary transfer bias rollers 79Y, 79M, 79C, and 79K, transfer biases each having an opposite polarity to that of toner are applied. Further, the intermediate transfer belt 78 runs in a direction as shown by arrow and sequentially passes through primary transfer nips 79Y, 79M, 79C, and 79K formed by the respective primary transfer bias rollers 79.

Thus, the respective component color toner images borne on the photoconductive drums 5Y, 5M, 5C, and 5K, are primarily transferred and are superimposed sequentially onto the intermediate transfer belt 78. Subsequently, the intermediate transfer belt 78 bearing the respective component color toner images primarily transferred and superimposed thereon in this way reaches a prescribed position opposed to the secondary transfer roller 89.

At this position, the secondary transfer roller 89 and the secondary transfer backup roller 82 collectively sandwich the intermediate transfer belt 78 and form a secondary transfer nip therebetween. Thus, the four-component color superimposed toner image formed on the intermediate transfer belt 78 is transferred at once onto the recording medium P conveyed to the secondary transfer nip.

At this moment, some of un-transferred toner not transferred onto the recording medium P remains on the intermediate transfer belt 78. After that, the intermediate transfer belt 78 reaches and enters an intermediate transfer cleaning unit 80. Then, some of the un-transferred toner remaining on the intermediate transfer belt 78 is collected at this position.

Hence, a series of transfer processes to be executed on the intermediate transfer belt is completed in this way. At that time, the recording medium P has been timed and conveyed to the secondary transfer nip from a sheet feeding unit 12 disposed in an lower section of the main body 1 of the image forming apparatus through a sheet feeding roller 97 and a pair of registration rollers 98 or the like.

More specifically, several recording media P, such as transfer sheets, etc., are enclosed being stacked in the sheet-feeding unit 12. Thus, when the sheet-feeding roller 97 is driven and is thus rotated counter-clockwise in FIG. 1, the top of the recording media P is fed toward a gap formed between the pair of registration rollers 98.

The recording medium P conveyed up to the pair of registration rollers 98 temporarily stops at a position of a roller nip formed between the pair of registration rollers 98 currently stopping its own driving. The pair of registration rollers 98 is subsequently rotated and driven synchronizing with a color image borne on the intermediate transfer belt 78, so that the recording medium P is conveyed toward the secondary transfer nip.

Hence, a desired color image is transferred onto the recording medium P in this way. The recording medium P with the color image transferred in the secondary transfer nip is further conveyed downstream to the fixing unit 20 after that.

Further, the color image transferred onto the recording medium P is fused thereonto by pressure and heat applied thereto from respective of the pressing roller 31 and the fixing belt 21 at this position. The recording medium P is subsequently ejected outside the image forming apparatus passing through a roller gap formed between a pair of sheet exit rollers 99 after that.

The recording medium P thus drained out by the pair of exit rollers 99 is stacked sequentially on a stack unit 100 as an output image. In this way, a series of image formation processes to be executed in the image forming apparatus is completed.

Now, exemplary operation and configuration of the fixing unit 20 provided in the image forming apparatus 1 is described in greater detail with reference to applicable drawings. Specifically, FIG. 2 schematically illustrates an exemplary fixing unit 20 as one embodiment of the present invention.

The fixing unit (i.e., a fixing unit 20) according to this embodiment includes an endless belt unit (e.g., a fixing belt 21) accommodating an internal heat source (e.g., a heater 25), a pressure roller (i.e., a pressing roller 31) rotating in contact with the fixing belt unit, and a heat transfer member (i.e., a heat transfer member 22) secured inside its circumferential surface heated by the internal heat source while supporting and heating the fixing belt unit. Also provided is a fixed member (i.e., a fixed member 26) also secured inside the inner circumferential surface of the fixing belt member and pressed against the pressure roller through the fixing belt unit. The fixing unit thus fixes an unfixed toner image borne on the recording medium P onto the recording medium P by applying pressure and heat at a pressure contact section between the pressure roller and the fixing belt unit. The heat transfer member has a convex portion (i.e., a convex portion 22*a*) at a prescribed position thereof in a rotation direction (i.e., a circumferential direction) of the fixing belt unit to partially narrow a gap between the heat transfer member and the fixing belt unit in a longitudinal direction (i.e., a widthwise direction) thereof.

Figure 2:
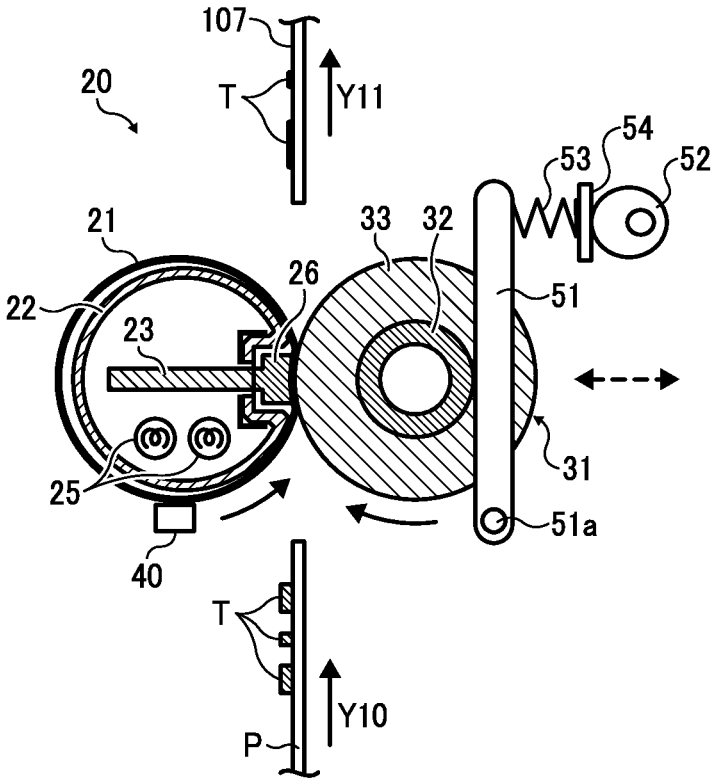
FIG. 2 is a cross-sectional view illustrating an overall configuration of an exemplary fixing unit according to another embodiment of the present invention.

Further, as shown in FIG. 2, the fixing unit 20 includes the fixing belt 21 as a belt unit, the fixed member 26, the heat transfer member 22, a reinforcing member 23, the heater 25 (i.e., the heat source), a pressing roller 31 as the pressure roller, a temperature sensor 40, and an engaging and disengaging mechanism 51 to 53 or the like.

The fixing belt 21 is endless and is composed of a flexible thin belt and rotates (travels) in a direction shown by arrow in FIG. 2 (i.e., counterclockwise). More specifically, the fixing belt 21 is formed from a substrate layer, an elastic layer, and a mold-releasing layer stacked sequentially from its inner circumferential surface and has a total thickness of less than about 1 mm. The substrate layer of the fixing belt 21 has a layer thickness of from about 30 μm to about 100 μm and is made of metal, such as nickel, stainless steel, etc., or a resin material, such as, polyimide, etc.

The elastic layer of the fixing belt 21 has a layer thickness of from about 100 μm to about 300 μm and is made of rubber material, such as silicone rubber, foamed silicone, fluoro rubber, etc. By providing the elastic layer, since fine unevenness of the surface of the fixing belt 21 is not created in the nip, heat diffuses evenly over a toner image T borne on a recording medium P, thereby protecting the surface of the toner image T from acquiring a so-called "orange peel" appearance.

The mold releasing layer of the fixing belt 21 has a layer thickness of from about 10 μm to about 50 μm and is made of material such as PFA (Polytetrafluoroethylene-perfluoroalkyl vinyl ether copolymer), PTFE (Polytetrafluoroethylene), polyimide, polyether imide, PES (Polyether sulfide), etc. By employing the releasing layer, de-molding performance (i.e., detachability) regarding toner (i.e., the toner image T) can be assured.

Further, the fixing belt 21 has a diameter of from about 15 mm to about 120 mm. In particular, the fixing belt 21 here has a diameter of about 30 mm in this exemplary embodiment.

The pressing roller 31 serving as a pressure roller bordering an outer circumferential surface of the fixing belt 21 at the nip has a diameter of from about 30 mm to about 40 mm. The pressing roller 31 is formed from a hollow metal core 32 and an elastic layer 33 overlying the hollow metal core 32.

The elastic layer 33 of the pressing roller 31 is made of material, such as foam silicone rubber, silicone rubber, fluoro rubber, etc. Here, a thin releasing layer made of material, such as PFA, PTFE, etc., can be provided on a surface of the elastic layered 33. The pressing roller 31 has a drum shape having different diameters at its center and side ends with a difference of from about 0.05 mm to about 0.25 mm. Further, the pressing roller 31 is pressed against the fixing belt 21 and forms a desired nip between these members.

The fixed member 26 is composed of heat-resistant resin material, such as PPS (polyphenylene sulfide), PAI (polyamide imide), PI (polyimide), LCP (liquid crystal polymer), etc. With provision of the elastic member, such as silicone, fluoro rubber, etc., between the fixed member 26 and the fixing belt 21, a belt surface can follow slight irregularities formed in the surface of the recording medium P in the nip, so that heat diffuses evenly over the toner image T borne on the recording medium P while effectively preventing an orange peel appearance to the toner image P.

The fixed member 26 has a concave cross-section in its surface facing the pressing roller 31 to follow a curvature of the pressing rollers 31. Hence, because the recording medium P can be sent from the nip almost following the curvature of the pressing roller 31, a problem in that the recording medium P is attracted and does not separate from the fixing belt 21 after the fixing process can be likely prevented to occur.

Further, although the shape of the cross section of the fixed member 26 forming the nip is concave as shown in FIG. 2, the shape may preferably continuously (i.e., gradually) vary from plane to concave states in the cross section of the fixed member 26 to form the nip.

When the shape of the nip is optionally changed to be almost parallel an image plane of the recording medium P, the recording medium P can effectively prevent from causing wrinkles. By contrast, by designing the shape approximating to the concave state, adhesion of the fixing belt 21 and the recording medium P to each other can be enhanced thereby capable of improving fixing performance thereof. Further, because the curvature of the fixing belt 21 grows on the exit side in the nip, the recording medium P launched from the nip can be readily separated from the fixing belt 21.

The heat transfer member 22 is a pipe state with a wall thickness of less than about 0.2 mm. As material of the heat transfer member 22, a metal heat conductor (i.e., metal having thermal conductivity), such as aluminum, steel, stainless steel, etc., can be used. By setting the wall thickness of the heat transfer member 22 to be less than about 0.2 mm, efficiency of heating the fixing belt 21 can be enhanced.

The heat transfer member 22 is provided either contacting or close to the inner circumferential surface of the fixing belt 21 at a position except for the nip. The heat transfer member 22 has an inwardly concave shape itself and has a concave portion with an opening at the nip. Here, a gap A (a gap formed at a prescribed position other than the nip) between the heat transfer member 22 and the fixing belt 21 is preferably greater than about 0 mm to less than about 1 mm (0 mm<A≤1 mm) under room temperature.

This deters a sliding area in the border between the heat transfer member 22 and the fixing belt 21 from growing greater and accelerating wearing of the fixing belt 21 as a problem. At the same time, a problem in that effectiveness of heating the fixing belt 21 drops due to an excessively far distance caused between the fixing belt 21 and the heat transfer member 22 can be deterred as well.

Further, since the heat transfer member 22 is placed nearby the flexible fixing belt 21, circular posture of the flexible fixing belt 21 can be maintained by some degree, damage or degradation of the fixing belt 21 due to its deformation can be likely reduced.

Further, to reduce sliding resistance caused between the fixing belt 21 and the heat transfer member 22, a sliding contact surface of the heat transfer member 22 in sliding contact with the fixing belt 21 can be made of material having a low coefficient of friction. Otherwise, a surface layer or the like can be formed on an inner circumference surface of the fixing belt 21, which is made of material including fluorine. Further, although the cross-section of the heat transfer member 22 is formed almost in a circular state as shown in FIG. 2, the cross-section of the heat transfer member 22 can be polygons as well.

The heat transfer member 22 is fixed and supported, for example, by a pair of side walls, not shown, provided in the fixing unit 20 via its widthwise ends, respectively, in the drawing. Further, the heat transfer member 22 is heated by radiant heat (i.e., a radiation light beam) emanated from a heater 25 configured by a carbon heater or a halogen heater and the like and heats the fixing belt 21.

Specifically, the heat transfer member 22 is directly heated by the heater 25 serving as a heating system. Whereas, the fixing belt 21 is indirectly heated by the heater 25 via the heat transfer member 22. The heater 25 is not disposed at a center of the heat transfer member 22 and is displaced therefrom to be located at a prescribed position to be able to effectively heat an upstream side of the nip.

Further, the heater 25 is controlled to output heat based on result of detecting surface temperature of the fixing belt 21 by a temperature sensor 40, such as a thermistor, etc., opposed to the surface of the fixing belt 21. Hence, by controlling the output of the heater 25 in this way, the temperature of the fixing belt 21 can also be controlled to be a desired level (i.e., fusing temperature).

In this way, since the heat transfer member 22 almost globally heats over the entire portion of the fixing belt 21 in a circumferential direction thereof rather than only locally heating the fixing belt 21 in the fixing system 20, the fixing belt 21 can be likely sufficiently heated while almost preventing poor fixing performance even if a system is speeded up. Note that, as the heater 25, although the halogen heater is employed as one example in the example as shown in FIG. 2, the type of the heat source is not limited to the halogen heater. For example, a heat induction type-heating source can be employed in the fixing unit as well.

Further, a reinforcing member 23 is provided to reinforce the fixed member 26 that forms the nip, and is secured at a position on an inner circumferential surface side of the fixing belt 21. Further, the reinforcing member 23 is formed to have a prescribed length in a widthwise direction almost equivalent to that of the fixed member 26, and is fixed to the pair of sidewalls (not shown) of the fixing unit 20 through its both side ends, respectively, in the widthwise direction.

Since the reinforcing member 23 is pressed against the pressing roller 31 via the fixed member 26 and the fixing belt 21, a problem in that the fixed member 26 is heavily deformed by pressure applied by the pressing roller 31 in the nip is likely suppressed. Here, to satisfy the above-described function, the reinforcing member 23 is preferably made of metal having great mechanical strength (i.e., rigidity), such as stainless steel, Ferroalloy, etc.

Further, if the heater 25 as the heat source employs a heating system with radiant heat, such as halogen heater, an insulation member can be either partially or entirely disposed in a surface of the reinforcing member 23 facing the heater 25. Otherwise, BA (i.e., Bright Anneal) or specular polishing processes can be applied thereto as well. Since the radiant heat emanated from the heater 25 toward the reinforcing member 23 (i.e., heat applied to the reinforcing member 23) is either insulated or reflected and is thereby used to heat the heat transfer member 22, effectiveness of heating the fixing belt 21 (and/or the heat transfer member 22) is further improved.

Further, a gear is attached to the pressing roller 31 meshing with a driving gear provided in a driving mechanism, not shown, so that the pressing roller 31 can be driven and rotated in a direction as shown by arrow (i.e., clockwise) in FIG. 2. Further, the pressing roller 31 is supported by the pair of sidesidewallst shown, of the fixing unit 20 via bearings at its both side ends in a widthwise direction, respectively, to freely rotate. Further, another heat source, such as a halogen heater, etc., may be installed again in the pressing roller 31.

Further, when the elastic layer 33 of the pressing roller 31 is made of sponge-like material, such as foaming silicone rubber, etc., since pressure applied to the nip can be likely weakened, an amount of vibration caused in the fixed member 26 can be likely reduced. Further, with the elastic layer 33, since insulation performance of the pressing roller 31 is enhanced and heat becomes harder to travel from the fixing belt 21 toward the pressing roller, effectiveness of heating the fixing belt 21 can be improved.

Further, although the fixing belt 21 is formed to have a diameter equivalent to that of the pressing roller 31 as one example as shown in FIG. 2, the diameter of the fixing belt 21 can be smaller than that of the pressing roller 31 as well. In such a situation, since curvature of the fixing belt 21 is smaller than that of the pressing roller 31 in the nip, the recording medium P thrown from the nip becomes easily separated from the fixing belt 21.

Further, although a diameter of the fixing belt 21 can be formed to be larger than that of the pressing roller 31, for example, these diameters are determined not to apply pressure of the pressing roller 31 to the heat transfer member 22 regardless of the magnitude relation between these respective diameters of the fixing belt 21 and the pressing roller 31.

Further, in the fixing unit 20, there are provided the engaging and disengaging mechanism 51 to 53 as already described to engage and disengage the pressing roller 31 with the fixing belt 21. The engaging and disengaging mechanism is composed of a pressing lever 51, an eccentric cam 52, and a compression spring 53. The pressing lever 51 is supported to freely rotate by the pair of side plates of the fixing unit 20, not shown, around a supporting axis 51*a* mounted to its one side end.

A center of the pressing lever 51 borders a bearing attached to the pressing roller 31. The bearing is movably held by oblong holes formed in the pair of the side plates, respectively, to be able to go and back. Further, the compression spring 53 is connected to the other end of the pressing lever 51. The eccentric cam 52 is configured to be freely rotated by a driving motor, not shown, that engages with a holding plate 54 attached to the compression spring 53.

With the configuration like this, when the eccentric cam 52 rotates, the pressing lever 51 also swings around the supporting axis 51*a*, so that the pressing roller 31 is displaced in a direction as shown by dashed line arrow in FIG. 2. Specifically, during a normal fixing process, the eccentric cam 52 is in a rotary angular state with orientation as shown in FIG. 2, so that the pressing roller 31 is pressed against the fixing belt 21 and forms a desired nip therebetween. By contrast, during a process (e.g., a sheet jam dealing process or a waiting process (i.e., a standby process), etc.), other than the normal fixing process, the eccentric cam 52 rotates by 180-degrees from the rotary angular state with orientation as shown in FIG. 2, so that the pressing roller 31 secedes from the fixing belt 21 (or decreases a tension of the fixing belt 21).

Now, image forming operation executed in the fixing unit 20 with the above-described configured during the normal fixing process is briefly described herein below with reference to applicable drawings. When a power switch provided in the main body 1 of the image forming apparatus is turned on, power is supplied to the heater 25 and rotation driving of the pressing roller 31 in a direction as shown by arrow in FIG. 2 is initiated.

Hence, the fixing belt 21 also starts following motion (i.e., rotated) due to friction applied by the pressing roller 31 in a direction as shown by arrow in FIG. 2. Subsequently, a recording medium P is fed from the sheet-feeding unit 12. An unfixed color image is subsequently (transferred and) borne on the recording medium P at the position of the secondary transfer roller 89 as shown in FIG. 1.

The recording medium P with the unfixed image T (i.e., the toner image T) is conveyed in a direction as shown by arrow Y10 in FIG. 2 while it is guided by a guide plate, not shown, and is inserted into the nip formed between the pressing roller 31 and the fixing belt 21 in a pressure contacting condition. Then, the toner image T borne on the surface of the recording medium P is fused by heat provided by the fixing belt 21 heated by the heat transfer member 22 (heated originally by the heater 25) and pressure collectively applied from the pressing roller 31 and the fixed member 26 which is reinforced by the reinforcing member 23. Subsequently, the recording medium P thrown from the nip is further conveyed downstream therefrom in a direction as shown by arrow Y11.

Figure 3B:
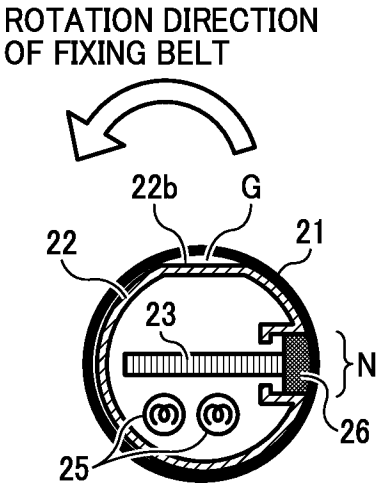
FIG. 3B RELATED ART
FIG. 3B is a cross-sectional view taken along line A-A of FIG. 3A.
Figure 3A:
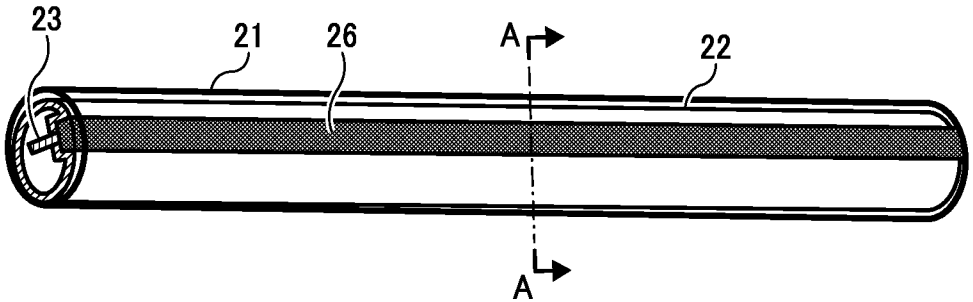
FIG. 3A RELATED ART
FIG. 3A is a diagram schematically illustrating a configuration of a main part (i.e., a fixing belt) of a conventional fixing unit.

Now, a heat transfer member is herein below described with reference to applicable drawings. Specifically, an exemplary configuration of the heat transfer member 22 provided in the fixing unit 20 according to one embodiment of the present invention is described in greater detail with reference to applicable drawings. First, however, a conventional configuration is described with reference to FIG. 3 for the purpose of comparing with various embodiments of the present invention. FIG. 3A is a diagram schematically illustrating a configuration of a main part (i.e., a fixing belt) of a conventional fixing unit 20. FIG. 3B is a cross-sectional view taken along line A-A of FIG. 3A.

In the configuration shown in FIG. 3, an upstream side (i.e., a lower side in the drawing) of the nip of the conventional heat transfer member 22 is formed in an arc shape. By contrast, however, on a downstream side of the nip (i.e., at an upper site in the drawing) of the conventional heat transfer member 22, a flat portion 22*b* is provided being sandwiched by arc shape portions thereof. Also as shown there, in the example of FIG. 3, the heat transfer member 22 has a common cross-sectional shape over the entire width in its widthwise direction. Specifically, the flat portion 22*b* is formed extending over its entire width in the widthwise direction.

In this way, by forming the flat portion 22*b* in the heat transfer member 22 downstream of the nip, the gap G can be provided between the fixing belt 21 and the heat transfer member 22. Further, by enlarging the gap G between the fixing belt 21 and the heat transfer member 22, sliding resistance caused therebetween can be likely reduced. However, in the meantime, movement of the fixing belt 21 becomes unstable due to vibration or sagging of the fixing belt 21.

In this regard, according to this embodiment, the heat transfer member 22 of the fixing unit 20 has a convex portion 22*a* partially protruding from the surface of the heat transfer member 22 at a prescribed position in both directions of rotation and longitudinal direction (i.e., a widthwise direction) of the fixing belt 21 to partially narrow the gap B between the heat transfer member 22 and the fixing belt 21 as shown in FIG. 4. Here, the convex portion 22*a* of the heat transfer member 22 and the inner circumferential surface of the fixing belt 21 may engage with each other. Otherwise, the convex portion 22*a* preferably provides a clearance of about 0.5 mm or less between the heat transfer member 22 and the inner circumferential surface of the fixing belt 21 as a smaller gap G.

Figure 4A:
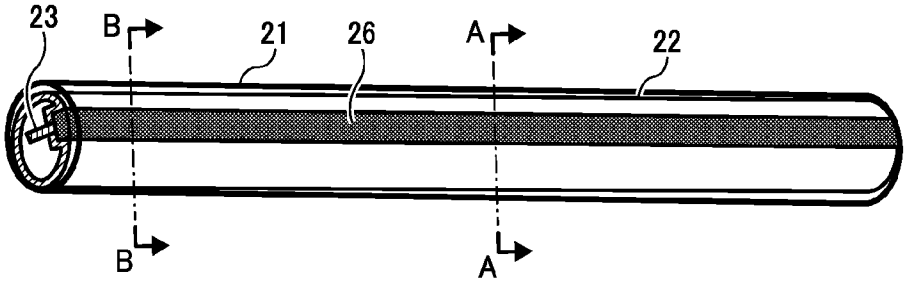
FIG. 4A is a diagram schematically illustrating a configuration of a main part (i.e., a fixing belt) of an exemplary fixing unit according to a first embodiment of the present invention.
Figure 4B:
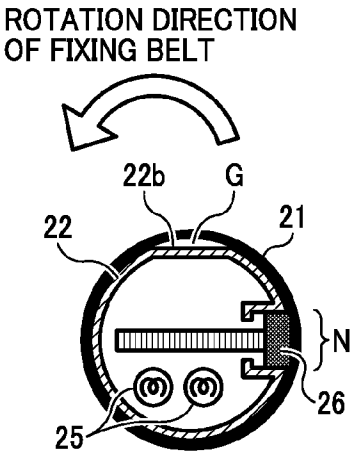
FIG. 4B is a cross-sectional view taken along line A-A of FIG. 4A according to the first embodiment of the present invention.
Figure 4C:
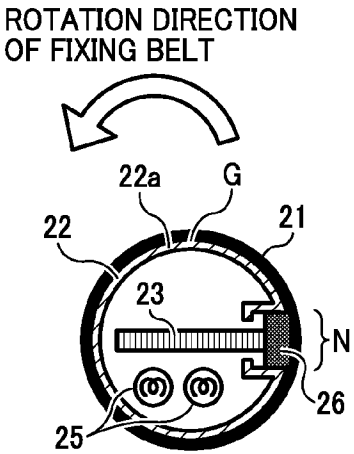
FIG. 4C is a cross-sectional view taken along line B-B of FIG. 4A according to the first embodiment of the present invention.

FIG. 4A is a diagram again schematically illustrating a configuration of a main part (i.e., the fixing belt) of the fixing unit 20 according to one embodiment of the present invention. FIG. 4B is a cross-sectional view taken along line A-A of FIG. 4A. FIG. 4C is also a cross-sectional view taken along line B-B of FIG. 4A.

In the A-A cross-section of the heat transfer member 22 shown by FIG. 4B, the gap G is similarly formed between the fixing belt 21 and the heat transfer member 22 while the flat section 22*b* is formed on the heat transfer member 22 at downstream of the nip as in the related art (i.e., conventional system) shown in FIG. 3 to reduce the sliding resistance again. On the other hand, however, in the cross-section B-B of the heat transfer member 22 shown in FIG. 4C, the convex portion 22*a* is formed omitting the flat portion 22*b* at downstream of the nip to minimize the gap G between the fixing belt 21 and the heat transfer member 22.

In this way, the gap G is uniformly formed in the longitudinal direction between the heat transfer member 22 and the fixing belt 21. Specifically, the convex portion 22*a* is partially provided (over the widthwise range of the heat transfer member 22) to partially minimize the gap G to reduce the contact area of the fixing belt 21 and the heat transfer member 22 contacting each other. With this, the sliding load can be minimized consequently more effectively than a situation in which the contact area is relatively wider.

Here, the convex portion 22*a* can be simply partially formed in the longitudinal range according to this embodiment of the present invention. Specifically, widthwise formation position and range the convex portion 22*a* in the longitudinal direction of the heat transfer member 22 are not limited to the above-described embodiment. For example, the convex portion 22*a* can be located in given ranges 22 extending from respective side ends of the heat transfer member 22, while the flat portion 22*b* can be formed on the heat transfer member 22 in a remaining center thereof in the longitudinal direction thereof as well. Further, for example, the flat portion 22*b* is located in a range of the heat transfer member 22, in which a recording medium passes through or the heater 25 applies heat, while the convex portions 22*a* are formed in the rest thereof at respective side ends in the longitudinal direction of the heat transfer member 22. Further, the convex portion 22*a* is favorably disposed downstream of the nip in the circumferential direction the fixing belt 21, but is not limited thereto.

Consequently, because the convex portion 22*a* is partially provided in the longitudinal direction of the heat transfer member 22 in this way while establishing the smaller gap section between the fixing belt 21 and the heat transfer member 22, conveyance performance of the fixing belt 21 can be stabilized while reducing the vibration and the sagging of the fixing belt 21 generally generated when a relatively large gap G is formed, thereby stabilizing the movement of the fixing belt 21.

Figure 5A:
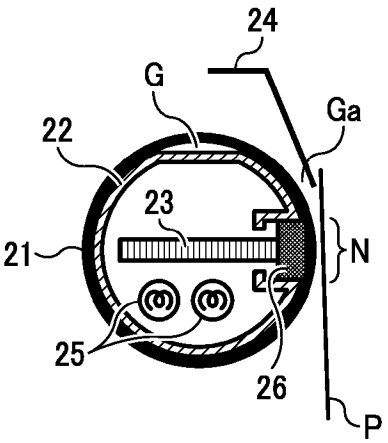
FIG. 5A is a diagram generally illustrating movement of a fixing belt when the fixing belt vibrates by an ordinary amount.
Figure 5B:
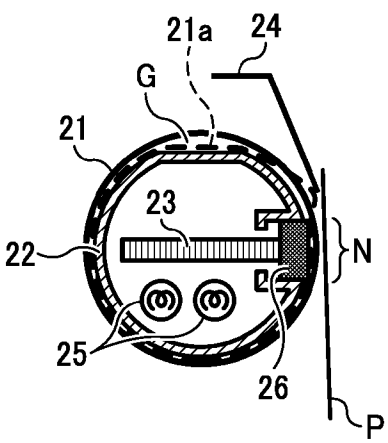
FIG. 5B is a diagram generally illustrating movement of the fixing belt when the fixing belt vibrates by a relatively great amount.
Figure 5C:
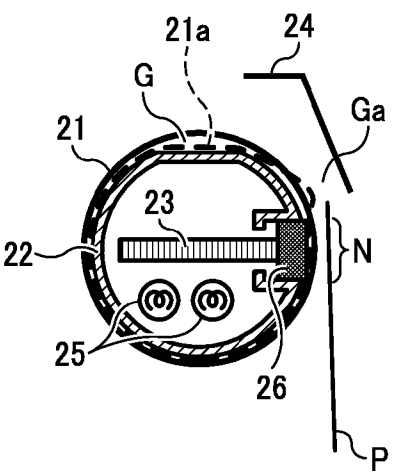
FIG. 5C is a diagram generally illustrating movement of the fixing belt when the fixing belt vibrates by a relatively great amount forming a relatively large gap Ga.

Now, movement of a fixing belt is herein below discussed with reference to applicable drawings. Specifically, the movement of the fixing belt 21 is more specifically described with reference to applicable drawings. FIGS. 5A to 5C is diagrams that collectively illustrate exemplary movement of the fixing belt 21. Specifically, FIG. 5A illustrates exemplary movement of the fixing belt 21 when belt vibration is an ordinary amount. FIG. 5B is a diagram illustrating exemplary movement of the fixing belt 21 when the fixing belt vibration is relatively great. FIG. 5C is a diagram illustrating exemplary movement of the fixing belt when the fixing belt vibration and the gap Ga are relatively great.

As shown in FIGS. 5A-5C, a separation member 24 is provided in the fixing unit 20 to separate a recording medium P from the fixing belt fixing 21 and guides it along a conveyance path extended downstream after the recording medium P exits from the nip N.

When the separation member 24 contacts an outer surface of the fixing belt 21, it puts scratches on the outer surface thereof due to confliction sliding of the fixing belt 21. Therefore, as shown in FIG. 5A, a certain gap Ga is secured and maintained between the outer surface of the fixing belt 21 and the separation member 24 in the fixing unit 20 not to put scratches thereon.

Here, when the gap G between the fixing belt 21 and the heat transfer member 22 is enlarged, the sliding resistance decreases. On the other hand, however, as shown in FIG. 5B, belt vibration and/or sagging grow in such a situation, and consequently, the prescribed gap Ga between the outer surface of the fixing belt 21 and the separation member 24 may not be maintained. Furthermore, the scar can likely occur in the fixing belt 21 when the fixing belt 21 contacts the separation member 24. Here, a reference numeral 21*a* shown by a broken line in the drawing indicates movement of the fixing belt when the vibration is relatively large. To avoid this phenomenon, as shown in FIG. 5C, the gap Ga is possibly enlarged as a countermeasure, for example.

However, when the gap Ga between the separation member 24 and the fixing belt 21 is enlarged in this way, a recording medium P likely enters the gap Ga, and is not separated by the separation member 24, thereby possibly twining around the fixing belt 21 raising a problem.

By contrast, according to this embodiment, the sliding load caused between the fixing belt 21 and the heat transfer member 22 in the fixing unit 20 is reduced while minimizing the gap G as described above to stabilize the movement of fixing belt. As a result, stable separation and conveyance performance of the recording medium P can be ensured.

Figure 6B:
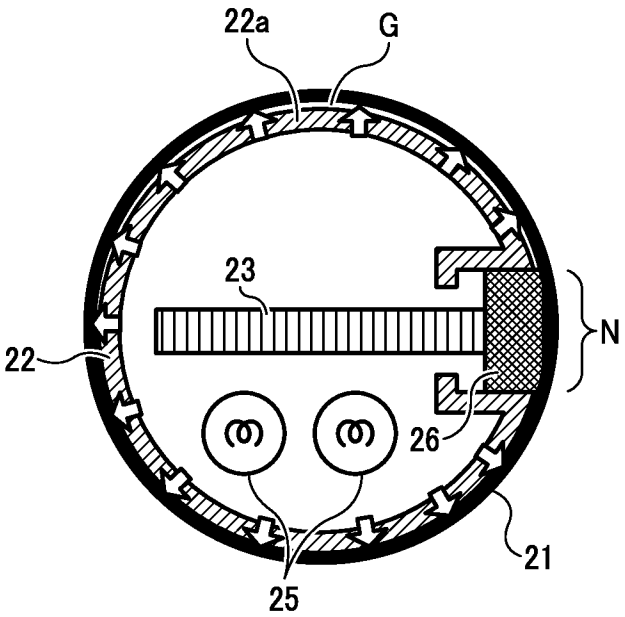
FIG. 6B is a diagram generally illustrating heat conduction of the heat transfer member when the gap G is relatively small.
Figure 6A:
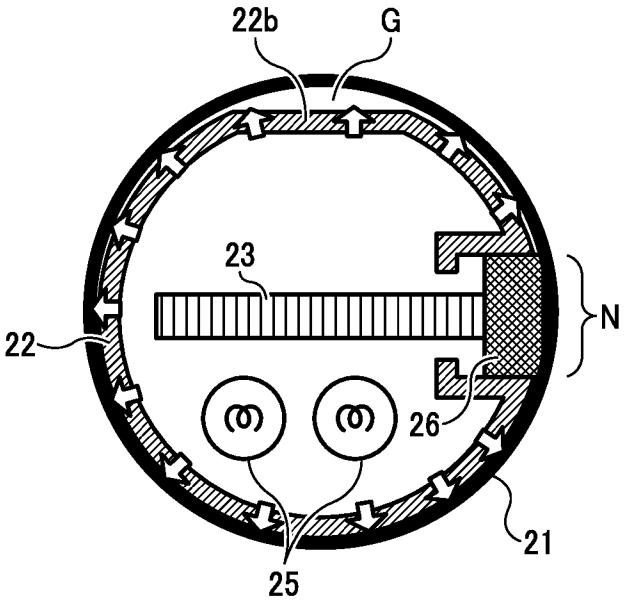
FIG. 6A is a diagram generally illustrating heat conduction of a heat transfer member when the gap G is relatively large.

Now, heat conduction is herein below discussed with reference to applicable drawings. According to this embodiment, heat transfer performance (i.e., thermal conductivity) exerted in the fixing unit 20 from the heat transfer member 22 to the fixing belt 21 is also advantageous as well. Specifically, FIGS. 6A and 6B are diagrams collectively illustrate exemplary heat conduction occurring in the fixing unit 20. More specifically, FIG. 6A illustrates heat conduction of the heat transfer member when the gap G is relatively large. Whereas, FIG. 6B illustrates the heat conduction of the heat transfer member when the gap G is relatively small.

As shown in FIG. 6A, when the gap G is relatively large, an air layer (i.e., the gap G) partially is present in a heat conduction route (as shown by arrow in the drawing) starting from the heat transfer member 22 ending at the fixing belt 21. Accordingly, when the gap G is relatively large, since the fixing belt 21 heated by the heat transfer member 22 is cooled by the air layer, the fixing belt 21 cannot be effectively heated.

To solve such a problem, the gap G between the fixing belt 21 and the heat transfer member 22 is reduced as described earlier, so that the heat conduction from the heat transfer member 22 becomes less susceptible to the air layer shown in FIG. 6B thereby stabilizing the heat conduction according to one embodiment of the present invention. Accordingly, since surface temperature of the fixing belt 21 and accordingly heat conduction thereof to the recording medium P can be stabilized as well, image quality can be again stabilized according to one embodiment of the present invention.

Now, heat deformation is discussed herein below with reference to applicable drawings. The fixing unit 20 can be driven only when surface temperature of the fixing belt 21 reaches a prescribed level (i.e., fixable temperature). That is, a sliding agent (e.g. lubricant) is generally used to reduce sliding load caused between the fixing belt 21 and the heat transfer member 22. Therefore, since the sliding agent generates a prescribed amount of load at low temperature, the fixing unit 20 is only driven to reduce the sliding load only after reducing viscosity of the sliding agent.

With such a driving system, in which the fixing unit 20 is not driven before the surface temperature of the fixing belt 21 reaches the prescribed level (i.e., fixable temperature), the heat transfer member 22 is heated by the heater 25 and may sometimes cause the heat deformation before the fixing belt 21 starts rotation driving.

Figure 7B:
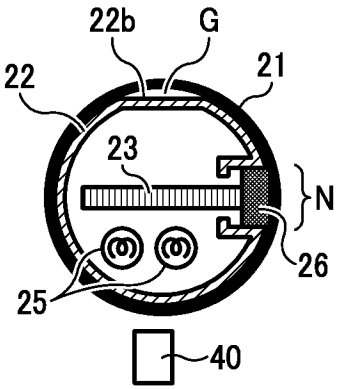
FIG. 7B is a cross-sectional view taken along line A-A of FIG. 7A generally illustrating thermal deformation caused in the heat transfer member before the heat transfer member is heated.
Figure 7A:
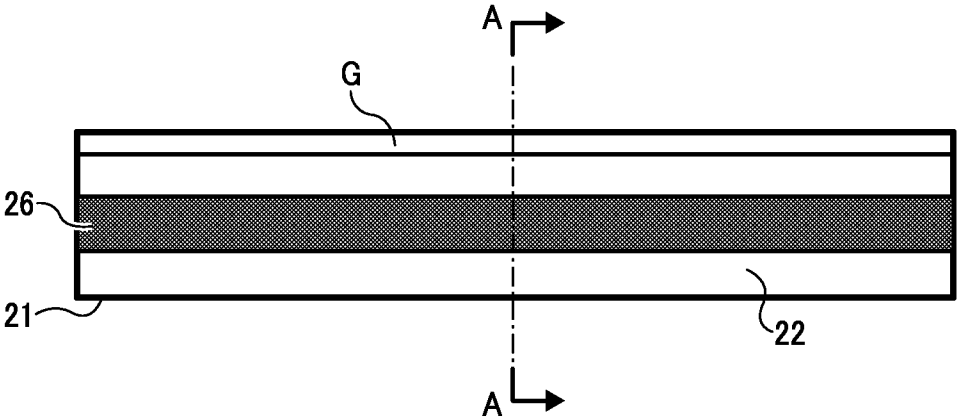
FIG. 7A is a front view of the fixing belt schematically illustrating first thermal deformation caused in the heat transfer member.
Figure 8C:
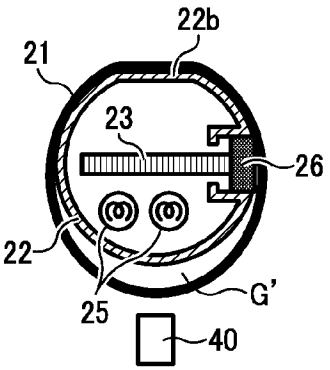
FIG. 8C is a cross-sectional view taken along line B-B of FIG. 8A when the heat transfer member is heated.
Figure 8B:
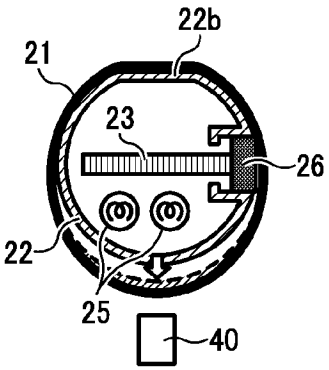
FIG. 8B is a cross-sectional view taken along line A-A of FIG. 8A when the heat transfer member is heated.
Figure 8A:
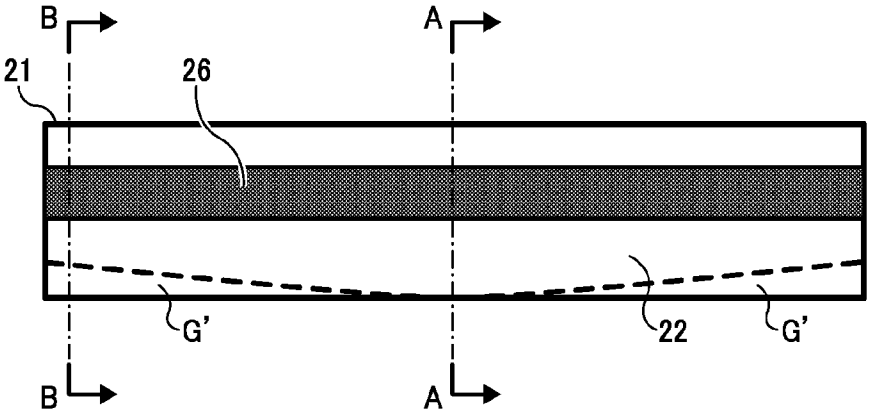
FIG. 8A is a front view of the fixing belt generally illustrating second thermal deformation caused in the heat transfer member.
Figure 9C:
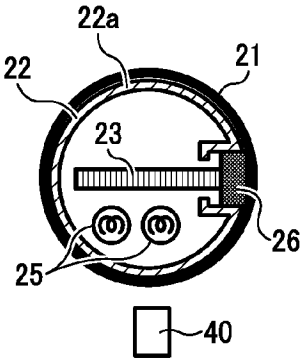
FIG. 9C is a cross-sectional view taken along line B-B of FIG. 9A when the heat transfer member is heated.

FIGS. 7A to 9C are diagrams collectively illustrating the thermal deformation possibly caused in the fixing unit 20. Specifically, FIG. 7A is a front view schematically illustrating a main part (i.e., a fixing belt) of a fixing unit 20 extended in a widthwise direction thereof. FIG. 7B is a cross-sectional view taken along line A-A of FIG. 7A before the fixing belt is heated. FIG. 8A is also a front view schematically illustrating the main part (i.e., the fixing belt) of the fixing unit 20 extended in the widthwise direction thereof. FIG. 8B is also a cross-sectional view taken along line A-A of FIG. 8A after the fixing belt is heated. FIG. 8C is a cross-sectional view again taken along line B-B of FIG. 8A after the fixing belt is heated. FIG. 9A is also a front view schematically illustrating the main part (i.e., the fixing belt) of the fixing unit 20 extended in the widthwise direction thereof. FIG. 9B is also a cross-sectional view taken along line A-A of FIG. 9A after the fixing belt is heated. FIG. 9C is a cross-sectional view again taken along line B-B of FIG. 9A after the fixing belt is heated.

When the heat transfer member 22 causes the heat deformation in a direction as shown by arrow in FIG. 8B after it is heated from the condition as shown in FIGS. 7A and 7B, the fixing belt 21 follows and is drawn by the heat transfer member 22 in the same direction in which the heat transfer member 22 deforms. Consequently, the gap G located above the heat transfer member 22 illustrated in FIG. 7B disappears, and a gap G' is newly created below the heat transfer member 22 as shown in FIG. 8C.

When the gap G' is created, the temperature sensors 40 (located in the cross sections along lines B-B and A-A, respectively,) each reads surface temperature of the fixing belt 21 based on a condition in which the gap G' exists between the heat transfer member 22 and the fixing belt 21 rather than a condition in which the heat transfer member 22 and the fixing belt 21 contact each other in the section along line B-B. Accordingly, a detected value is lower than reality.

Therefore, to obtain a desired amount of the surface temperature of the fixing belt, the heater 25 excessively heats the heat transfer member 22 (e.g. an excessive overheat condition) than when the heat transfer member 22 contacts the fixing belt 21. As a result, heating load is repeatedly posed on the fixing unit 20 (i.e., the heat transfer member 22), consequently.

Figure 9B:
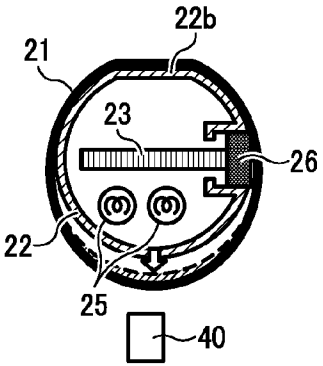
FIG. 9B is a cross-sectional view taken along line A-A of FIG. 9A when the heat transfer member is heated.
Figure 9A:
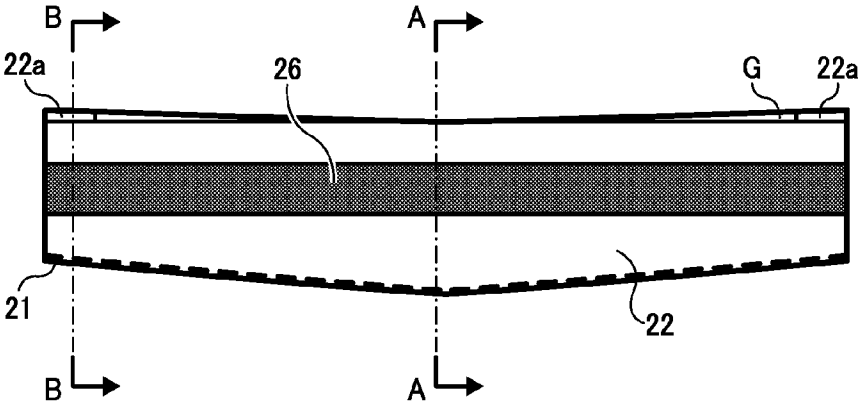
FIG. 9A is a front side view of the fixing belt generally illustrating third thermal deformation of the heat transfer member.

However, by forming convex portions 22*a* at respective side ends in a width-wise direction of the heat transfer member 22, for example, and thereby reducing the gap G between the fixing belt 21 and the heat transfer member 22 as in the above-described embodiment of the present invention as a countermeasure against the excessive heating caused by the thermal deformation of the heat transfer member 22 as well, the gap G' can be minimized as shown in FIGS. 9A to 9C. Specifically, by minimizing the gap G', the overheat condition of the heat transfer member 22 can be likely prevented while reducing the heat load posed on the fixing unit 20.

Now, the other fixing unit 20 according to a second embodiment of the present invention is described with reference to applicable drawings. However, the same or similar configuration and operation as already described in the first embodiment is omitted herein below to avoid repetition.

Figure 10:
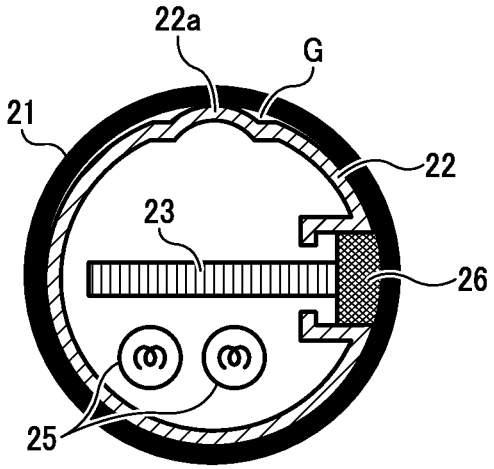
FIG. 10 is a diagram schematically illustrating a configuration of a main part (i.e., a fixing belt) of a fixing unit 20 according to a second embodiment of the present invention.

FIG. 10 is a diagram schematically illustrating a configuration of a main part (i.e., a fixing belt) of a fixing unit 20 according to the second embodiment of the present invention. As shown in the drawing, to reduce the gap G between the inner circumferential surface of the fixing belt 21 and the heat transfer member 22, a convex portion 22*a* is produced in the heat transfer member 22 by applying a drawing process to the heat transfer member 22 in this embodiment.

With the convex portion 22*a* thus obtained by applying the drawing process as shown in FIG. 10, a contact area in which the inner circumferential surface of the fixing belt 21 and the heat transfer member 22 contact each other can be more largely reduced when compared with the arc shape convex portion 22*a* as described in the first embodiment. Consequently, since the contact area in which the inner circumferential surface of the fixing belt 21 and the heat transfer member 22 contact each other is reduce, the sliding load can be accordingly reduced. Further, with the drawing process, rigidity of the heat transfer member 22 can be also enhanced. Because of this, the heat transfer member 22 can be formed thinner, and accordingly heat conduction performance thereof can be upgraded as well.

Figure 11:
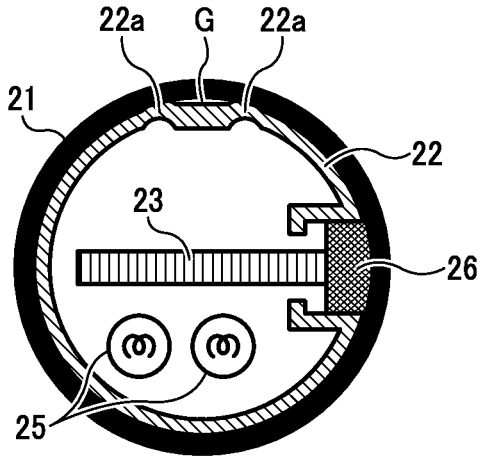
FIG. 11 is a diagram schematically illustrating a configuration of a main part (i.e., a fixing belt) of a fixing unit 20 according to a third embodiment of the present invention.

Now, yet the other fixing unit 20 according to a third embodiment of the present invention is described with reference to FIG. 11. As shown in FIG. 11, a configuration of a main part (i.e., a fixing belt) of a fixing unit 20 according to the third embodiment of the present invention is schematically illustrated. Specifically, multiple convex portions 22*a* are formed in the heat transfer member 22 in its circumferential direction in this embodiment.

With such a configuration of the multiple convex portions 22*a* formed in the circumferential direction of the heat transfer member 22, multiple contact sections are provided to support the inner circumferential surface of the fixing belt 21, so that movement of fixing belt 21 can be more stabilized. Further, the heat transfer member 22 can be formed thinner at the same time, and accordingly heat conduction performance thereof can be upgraded as well.

Figure 12A:
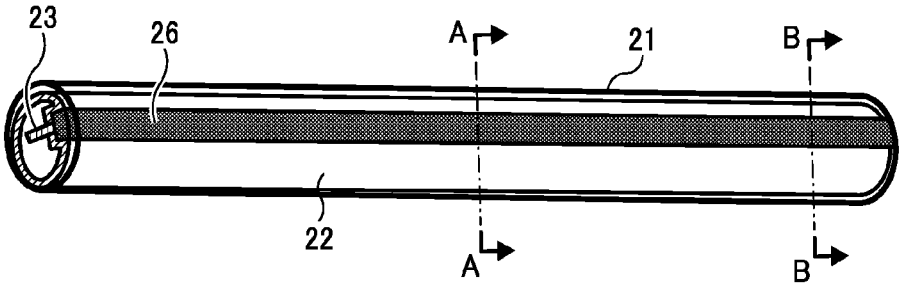
FIG. 12A is a perspective view schematically illustrating a configuration of a main part (i.e., a fixing belt) of a fixing unit 20 according to a fourth embodiment of the present invention.
Figure 12B:
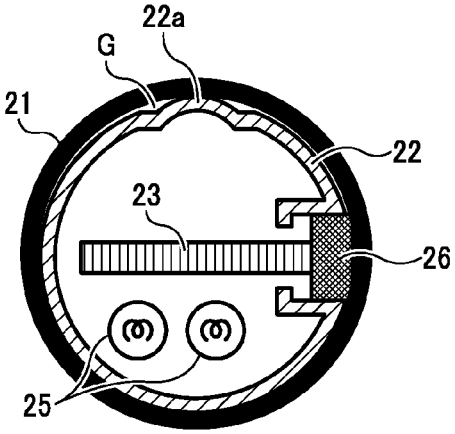
FIG. 12B is a cross-sectional view taken along line A-A of FIG. 12A according to the fourth embodiment of the present invention.
Figure 12C:
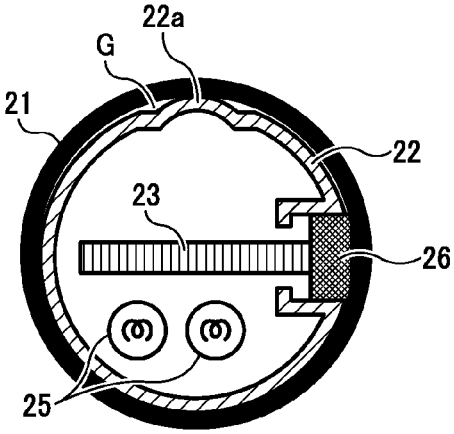
FIG. 12C is a cross-sectional view taken along line B-B of FIG. 12A according to the fourth embodiment of the present invention.

Now, yet the other fixing unit 20 according to a fourth embodiment of the present invention is described with reference to FIGS. 12A to 12C. Specifically, FIGS. 12A to 12C are diagrams schematically illustrating a configuration of a main part of the fixing unit 20 (i.e., a fixing belt) according to the fourth embodiment of the present invention. More specifically, FIG. 12A is a perspective view schematically illustrating a configuration of a main part (i.e., a fixing belt) of a fixing unit 20. FIG. 12B is a cross-sectional view taken along line A-A of FIG. 12A. FIG. 12C is a cross-sectional view taken along line B-B of FIG. 12A. As shown there, multiple convex portions 22*a* are again formed in the heat transfer member 22 in its longitudinal direction in this embodiment.

In this way, with such a configuration of the multiple convex portions 22*a* in the longitudinal direction of the heat transfer member 22, multiple contact sections are provided to support the inner circumferential surface of the fixing belt 21 in the longitudinal direction, so that movement of the fixing belt 21 can be more stabilized.

Figure 13A:
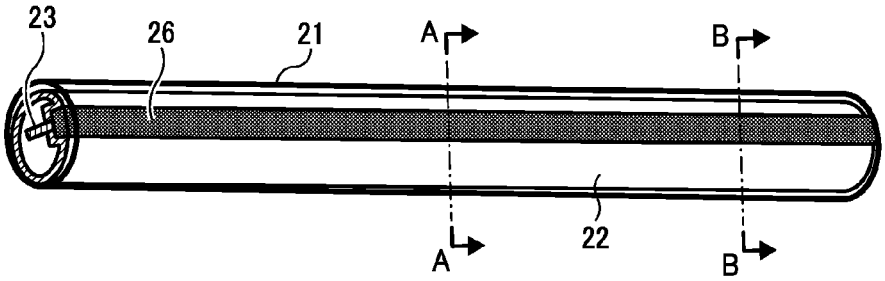
FIG. 13A is a diagram schematically illustrating a configuration of a main part (i.e., a fixing belt) of a fixing unit according to a fifth embodiment of the present invention.
Figure 13B:
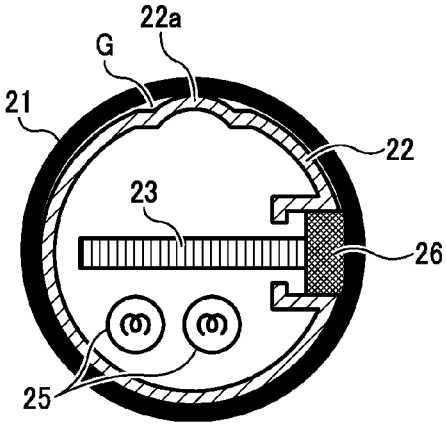
FIG. 13B is a cross-sectional view taken along line A-A of FIG. 13A according to the fifth embodiment of the present invention.
Figure 13C:
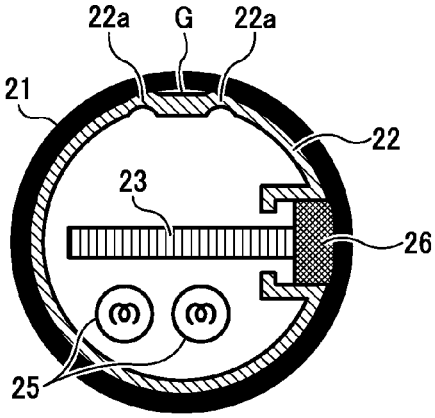
FIG. 13C is a cross-sectional view taken along line B-B of FIG. 13A according to the fifth embodiment of the present invention.

Now, yet the other fixing unit 20 according to a fifth embodiment of the present invention is described with reference to FIGS. 13A to 13C. Specifically, FIGS. 13A to 13C collectively schematically illustrate a configuration of a main part (i.e., a fixing belt) of the fixing unit 20 according to the fifth embodiment of the present invention. More specifically, FIG. 13A schematically illustrates a configuration of a main part of a fixing unit (i.e., a fixing belt). FIG. 13B is a cross-sectional view taken along line A-A of FIG. 13A. FIG. 13C is again a cross-sectional view taken along line B-B of FIG. 13A. As shown, multiple convex portion 22*a* having different height from the other are formed in the heat transfer member 22 in its longitudinal direction in this embodiment.

Specifically, even when heat is not uniformly distributed in the longitudinal direction of the heat transfer member 22 and accordingly a quantity of thermal expansion (locally) varies in the heat transfer member 22 or the fixing belt 21 due to an arranged position of the heater 25, such problems can be solved by varying the height of the convex portion 22*a*.

Figure 14A:
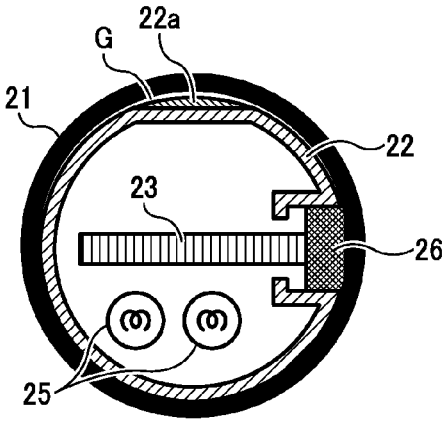
FIG. 14A is a diagram schematically illustrating a configuration of a main part (i.e., a fixing belt) of a fixing unit according to a sixth embodiment of the present invention.
Figure 14B:
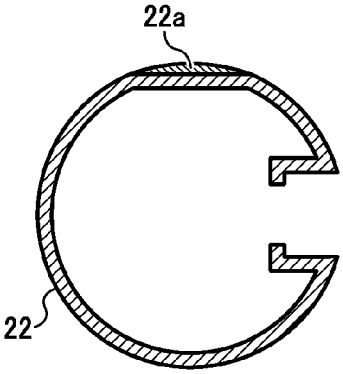
FIG. 14B is a cross-sectional view illustrating a heat transfer member employed in the fixing unit shown in FIG. 14A according to the sixth embodiment of the present invention.

Now, yet the other fixing unit 20 according to a sixth embodiment of the present invention is described with reference to FIGS. 14A and 14B. Specifically, FIG. 14A schematically illustrates a configuration of a main part (i.e., a fixing belt) of a fixing unit 20. FIG. 14B is a cross-sectional view illustrating the heat transfer member 22 employed in the fixing unit 20 shown in FIG. 14A. In this embodiment, the convex portion 22*a* of the heat transfer member 22 is not integral with a body of the heat transfer member 22 and is detachably attached to the due to an arranged position of the heater 25 as a separate member therefrom.

Hence, with the convex portion 22*a* separately configured from the body of the heat transfer member 22, a shape of the convex portion is not limited to that as produced by using the drawing process, and accordingly the convex portion 22*a* can be optionally shaped. Although the convex portion 22*a* employs the arc shape in FIG. 14 as one example, the shape is not limited thereto.

Further, by separately providing the convex portion 22*a* from the body of the heat transfer member 22 and choosing different material for the convex portion 22*a* from that of the body of the heat transfer member 22, a coefficient of thermal expansion and that of friction (i.e., sliding performance) can be preferably adjusted as well. Further, the convex portion 22*a* separated from the body of the heat transfer member 22 can be attached after painting the heat transfer member 22 as well.

Accordingly, even when the fixing belt 21 generates thermal expansion, the gap G can be prevented from growing by appropriately choosing a member capable of adjusting a difference in expansion between the fixing belt 21 and the heat transfer member 22. Further, choice of prescribed material excellent in sliding properties stabilizes movement of the fixing belt 21 while reducing a load.

Hence, according to one embodiment of the present invention, movement of a belt unit can be easily stabilized while readily reducing a sliding load caused between the fixing belt unit and the heat transfer member and increasing in torque as well by reducing sagging and vibration of the fixing belt unit. Specifically, in the fixing unit 20 described heretofore, the convex portion 22*a* is partially provided in the heat transfer member 22 in a longitudinal direction to reduce a gap between the heat transfer member 22 and the inner circumferential surface of the fixing belt 21, so that the contact area of the fixing belt 21 and the heat transfer member 22 contacting each other and Accordingly the sliding load can be easily reduced, thereby capable of preventing torque from increasing. Furthermore, vibration and sagging of the fixing belt 21 can be reduced thereby capable of stabilizing movement of the fixing belt 21. Accordingly, sheet jamming, wrinkles of a recording medium, and image noise can be likely prevented. Further, a quality image can be constantly obtained by upgrading thermal conductivity while stabilizing temperature of the fixing belt 21.

That is, according to one aspect of the present invention, a fixing unit includes an endless belt unit accommodating a heat source inside thereof and a pressure roller to rotate in contact with the fixing belt unit. The pressure roller and the fixing belt unit collectively form the pressure border therebetween. A heat transfer member is heated by the heat source and heats the fixing belt unit. The heat transfer member is secured inside an inner circumferential surface of the fixing belt unit and supports the fixing belt unit. A fixed member is secured inside the inner circumferential surface of the fixing belt unit and is pressed against the pressure roller via the fixing belt unit. The heat transfer member has at least one convex portion partially formed in an outer circumferential surface of the heat transfer member in a rotational direction of the fixing belt unit and a longitudinal direction of the heat transfer member to narrow a gap between the heat transfer member and the fixing belt unit.

Further, according to another aspect of the present invention, the at least one convex portion of the heat transfer member is formed at a position downstream from the pressure border between the pressure roller and the fixing belt unit in the rotational direction of the fixing belt unit. Further, according to yet another aspect of the present invention, multiple convex portions are formed in the heat transfer member in the circumferential direction of the fixing belt unit. According to yet another aspect of the present invention, multiple convex portions are formed in the heat transfer member in a longitudinal direction of the heat transfer member. According to yet another aspect of the present invention, at least one of the multiple convex portions has a different height from another one of the multiple convex portions. Furthermore, according to yet another aspect of the present invention, the at least one convex portion of the heat transfer member either contacts the fixing belt unit or is distanced from the fixing belt unit via a gap of about 0.5 mm or less. According to yet another aspect of the present invention, the at least one convex portion of the heat transfer member is produced by drawing. According to yet another aspect of the present invention, the at least one convex portion of the heat transfer member is formed by a separate member from the body of the heat transfer member.

According to yet another aspect of the present invention, the at least one heat transfer member is made of one of aluminum, iron, and stainless steel.

Further, an image forming apparatus (shown in FIG. 1) employing the above-described configuration of the fixing unit 20 can stabilize movement of the fixing belt 21 thereof while almost preventing sheet jamming, wrinkles of a recording medium, and image noise.

That is, according to one aspect of the present invention, an image forming apparatus includes an unfixed toner image formation system to form an unfixed toner image on a recording medium, and a fixing unit to fix the unfixed toner image borne on the recording medium onto the recording medium by applying a pressure heating process thereto at a pressure border. The fixing unit a fixing unit includes an endless belt unit accommodating a heat source inside thereof and a pressure roller to rotate in contact with the fixing belt unit. The pressure roller and the fixing belt unit collectively form the pressure border therebetween. A heat transfer member is heated by the heat source and heats the fixing belt unit. The heat transfer member is secured inside an inner circumferential surface of the fixing belt unit and supports the fixing belt unit. A fixed member is secured inside the inner circumferential surface of the fixing belt unit and is pressed against the pressure roller via the fixing belt unit. The heat transfer member has at least one convex portion partially formed in an outer circumferential surface of the heat transfer member in a rotational direction of the fixing belt unit and a longitudinal direction of the heat transfer member to narrow a gap between the heat transfer member and the fixing belt unit.

In another aspect of the present invention, a method of forming a toner image comprises the steps of: forming an unfixed toner image on a recording medium with an unfixed toner image formation system; conveying the recording medium with the unfixed toner to a fixing nip formed between an endless belt unit accommodating a heat source inside thereof and a pressure roller to rotate in contact with the fixing belt unit, the endless belt unit being pressed against the pressure roller by a fixed member secured inside an inner circumferential surface of the fixing belt unit; heating a heat transfer member secured inside the inner circumferential surface of the fixing belt unit by the heat source; supporting the fixing belt unit with heating a heat transfer member via at least one convex portion partially formed in an outer circumferential surface of the heat transfer member in a rotational direction of the fixing belt unit and a longitudinal direction of the heat transfer member to narrow a gap between the heat transfer member and the fixing belt unit; heating the fixing belt unit via the heat transfer member; and fixing the unfixed toner image borne on the recording medium onto the recording medium by applying pressure and heat thereto in the fixing nip.

Numerous additional modifications and variations of the present invention are possible in light of the above teachings. It is therefore to be understood that within the scope of the appended claims, the present invention may be executed otherwise than as specifically described herein. For example, the order of steps for forming the image forming apparatus is not limited to the above-described various embodiments and can be changed as appropriate.

What is claimed is:

1. A fixing unit for fixing an unfixed toner image onto a recording medium by applying a pressure heating process thereto at a pressure border, the fixing unit comprising:

an endless belt unit accommodating a heat source inside thereof;

a pressure roller to rotate in contact with the fixing belt unit, the pressure roller and the fixing belt unit forming the pressure border therebetween;

a heat transfer member heated by the heat source to heat the fixing belt unit, the heat transfer member secured inside an inner circumferential surface of the fixing belt unit supporting the fixing belt unit; and a fixed member secured inside the inner circumferential surface of the fixing belt unit and pressed against the pressure roller via the fixing belt unit, wherein the heat transfer member includes a flat portion and at least one convex portion, the flat portion, disposed in a center of a longitudinal direction of the heat transfer member and on a downstream side of a nip portion, forms a gap between the heat transfer member and the axing belt unit, and the at least one convex portion is partially formed in an outer circumferential surface of the heat transfer member in a rotational direction of the fixing belt unit and the longitudinal direction of the heat transfer member to narrow the gap between the heat transfer member and the fixing belt unit.

2. The fixing unit as claimed in claim 1, wherein the at least one convex portion of the heat transfer member is formed at a position downstream from the pressure border between the pressure roller and the fixing belt unit in the rotational direction of the fixing belt unit.

3. The fixing unit as claimed in claim 1, wherein multiple convex portions are formed in the heat transfer member in the circumferential direction of the fixing belt unit.

4. The fixing unit as claimed in claim 1, wherein multiple convex portions are formed in the heat transfer member in a longitudinal direction of the heat transfer member.

5. The fixing unit as claimed in claim 3, wherein at least one of the multiple convex portions has a different height from any other one convex portion.

6. The fixing unit as claimed in claim 1, wherein the at least one convex portion of the heat transfer member either contacts the fixing belt unit or is distanced from the fixing belt unit via a gap of about 0.5 mm or less.

7. The fixing unit as claimed in claim 1, wherein the at least one convex portion of the heat transfer member is produced by drawing.

8. The fixing unit as claimed in claim 1, wherein the at least one convex portion of the heat transfer member is formed by a prescribed member separate from the body of the heat transfer member.

9. The fixing unit as claimed in claim 1, wherein the at least one heat transfer member is made of aluminum, iron, or stainless steel.

10. An image forming apparatus comprising:

an unfixed toner image formation system to form an unfixed toner image on a recording medium, and a fixing unit to fix the unfixed toner image onto a recording medium by applying a pressure heating process thereto at a pressure border, the fixing unit including:

an endless belt unit accommodating a heat source inside thereof;

a pressure roller to rotate in contact with the fixing belt unit, the pressure roller and the fixing belt unit forming the pressure border therebetween;

a heat transfer member heated by the heat source to heat the fixing belt unit, the heat transfer member secured inside an inner circumferential surface of the fixing belt unit and supporting the fixing belt unit; and a fixed member secured inside the inner circumferential surface of the fixing belt unit and pressed against the pressure roller via the fixing belt unit, wherein the heat transfer member includes a flat portion and at least one convex portion, the flat portion, disposed in a center of a longitudinal direction of the heat transfer member and on a downstream side of a nip portion, forms a gap between the heat transfer member and the fixing belt unit, and the at least one convex portion is partially formed in an outer circumferential surface of the heat transfer member in a rotational direction of the fixing belt unit and the longitudinal direction of the heat transfer member to narrow the gap between the heat transfer member and the fixing belt unit.

11. The image forming apparatus as claimed in claim 10, wherein the at least one convex portion of the heat transfer member is formed at a position downstream from the pressure border between the pressure roller and the fixing belt unit in the rotational direction of the fixing belt unit.

12. The image forming apparatus as claimed in claim 10, wherein multiple convex portions are formed in the heat transfer member in the circumferential direction of the fixing belt unit.

13. The image forming apparatus as claimed in claim 10, wherein multiple convex portions are formed in the heat transfer member in a longitudinal direction of the heat transfer member.

14. The image forming apparatus as claimed in claim 12, wherein at least one of the multiple convex portions has a different height from another one of the multiple convex portions.

15. The image forming apparatus as claimed in claim 10, wherein the at least one convex portion of the heat transfer member either contacts the fixing belt unit or is distanced from the fixing belt unit via a gap of about 0.5 mm or less.

16. The image forming apparatus as claimed in claim 10, wherein the at least one convex portion of the heat transfer member is produced by drawing.

17. The image forming apparatus as claimed in claim 10, wherein the at least one convex portion of the heat transfer member is formed by a prescribed member separate from the body of the heat transfer member.

18. The image forming apparatus as claimed in claim 10, wherein the at least one heat transfer member is made of one of aluminum, iron, and stainless steel.

19. A method of forming a toner image, comprising:

forming an unfixed toner image on a recording medium with an unfixed toner image formation system;

conveying the recording medium with the unfixed toner to a fixing nip formed between an endless belt unit accommodating a heat source inside thereof and a pressure roller to rotate in contact with the fixing belt unit, the endless belt unit being pressed against the pressure roller by a fixed member secured inside an inner circumferential surface of the fixing belt unit;

heating a heat transfer member secured inside the inner circumferential surface of the fixing belt unit by the heat source;

supporting the fixing belt unit with heating a heat transfer member via a flat portion and at least one convex portion, the flat portion, disposed in a center of a longitudinal direction of the heat transfer member and on a downstream side of a nip portion, forms a gap between the heat transfer member and the fixing belt unit, and the at least one convex portion partially formed in an outer circumferential surface of the heat transfer member in a rotational direction of the fixing belt unit and the longitudinal direction of the heat transfer member, the at least one convex portion narrowing the gap between the heat transfer member and the fixing belt unit; and fixing the unfixed toner image onto the recording medium by applying pressure and heat thereto in the fixing nip.

20. The method as claimed in claim 19, wherein the at least one convex portion of the heat transfer member is formed at a position downstream from the fixing nip formed between the pressure roller and the fixing belt unit in the rotational direction of the fixing belt unit.

* * * * *